US006788791B2

(12) United States Patent
Smith et al.

(10) Patent No.: US 6,788,791 B2
(45) Date of Patent: Sep. 7, 2004

(54) DELAY NETWORK MICROPHONES WITH HARMONIC NESTING

(75) Inventors: Steven S. Smith, Evanston, IL (US); Richard J. Santiago, Oak Creek, WI (US); Mark Gilbert, Park Ridge, IL (US); Alan J. Usdrowski, Elk Grove Village, IL (US)

(73) Assignee: Shure Incorporated, Niles, IL (US)

( * ) Notice: Subject to any disclaimer, the term of this patent is extended or adjusted under 35 U.S.C. 154(b) by 73 days.

(21) Appl. No.: 10/325,546

(22) Filed: Dec. 20, 2002

(65) Prior Publication Data

US 2004/0037168 A1 Feb. 26, 2004

Related U.S. Application Data

(60) Provisional application No. 60/402,185, filed on Aug. 9, 2002.

(51) Int. Cl.[7] ..... H04R 3/00

(52) U.S. Cl. ..... 381/92; 381/122; 381/357; 367/178

(58) Field of Search ..... 381/91, 92, 122, 381/75, 26, 111, 113, 114, 115, 335, 356, 357, 358, 338, 382, 361, 362; 367/178

(56) References Cited

U.S. PATENT DOCUMENTS

| | | | | | |
|---|---|---|---|---|---|
| 2,228,886 | A | * | 1/1941 | Olson | 181/158 |
| 3,573,400 | A | * | 4/1971 | Sessler et al. | 381/357 |
| 4,002,859 | A | * | 1/1977 | Schoeps et al. | 381/113 |
| 4,421,957 | A | * | 12/1983 | Wallace, Jr. | 381/338 |
| 4,555,598 | A | * | 11/1985 | Flanagan et al. | 381/338 |
| 4,696,043 | A | * | 9/1987 | Iwahara et al. | 381/92 |
| 4,703,506 | A | * | 10/1987 | Sakamoto et al. | 381/92 |
| 5,058,170 | A | * | 10/1991 | Kanamori et al. | 381/92 |
| 5,137,110 | A | * | 8/1992 | Bedard et al. | 181/153 |
| 5,862,240 | A | * | 1/1999 | Ohkubo et al. | 381/356 |
| 6,158,902 | A | * | 12/2000 | Staat | 381/357 |
| 6,330,540 | B1 | | 12/2001 | Dischler | |
| 6,694,028 | B1 | * | 2/2004 | Matsuo | 381/92 |

FOREIGN PATENT DOCUMENTS

| | | |
|---|---|---|
| FR | 2282768 | 3/1976 |
| FR | 2552291 | 3/1985 |

OTHER PUBLICATIONS

International Search Report for PCT/US03/24759 mailed Dec. 22, 2003.

* cited by examiner

*Primary Examiner*—Xu Mei
(74) *Attorney, Agent, or Firm*—Banner & Witcoff, Ltd.

(57) ABSTRACT

The invention provides method and apparatus that utilize a plurality of port sub-arrays, in which each port sub-array comprises a plurality of acoustical ports. The ports of each port sub-array are spaced so that each port sub-array responds to acoustical signals that are generated by acoustical sources within an associated frequency range. In an embodiment of the invention, associated frequency ranges are related in a harmonic manner, in which each port sub-array corresponds to different frequency octaves. The associated frequency range is a portion of the total frequency range of an acoustical system. Received acoustical signals from each of the port sub-arrays are coupled over acoustical pathways and are converted into electrical signals by capsules that may be mounted in a capsule mounting. The electrical signals may be filtered, such as to reduce spatial aliasing, and post processed to further enhance the characteristics of the signals.

41 Claims, 7 Drawing Sheets

FIG.2
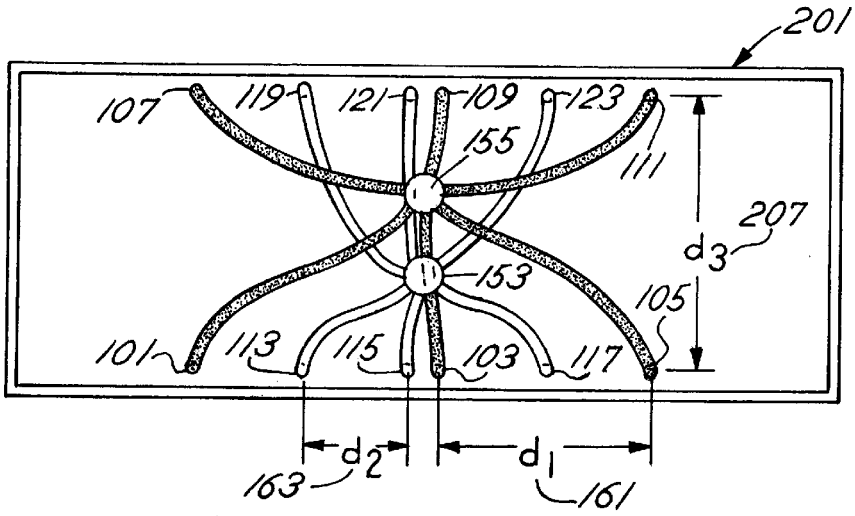
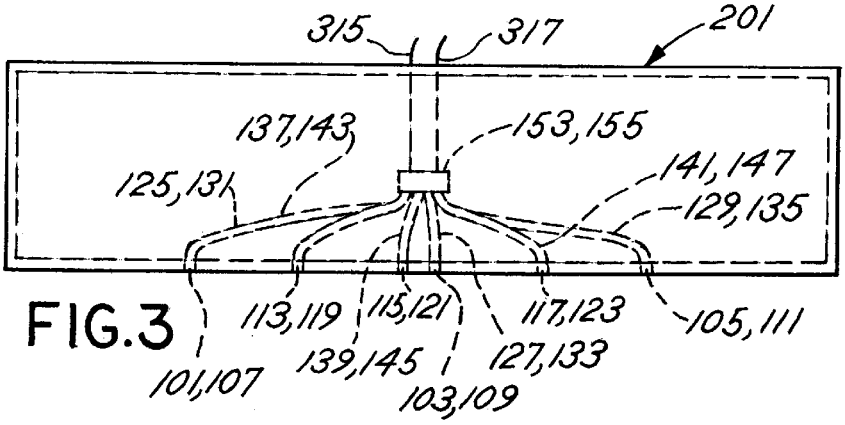
FIG.3
FIG.4
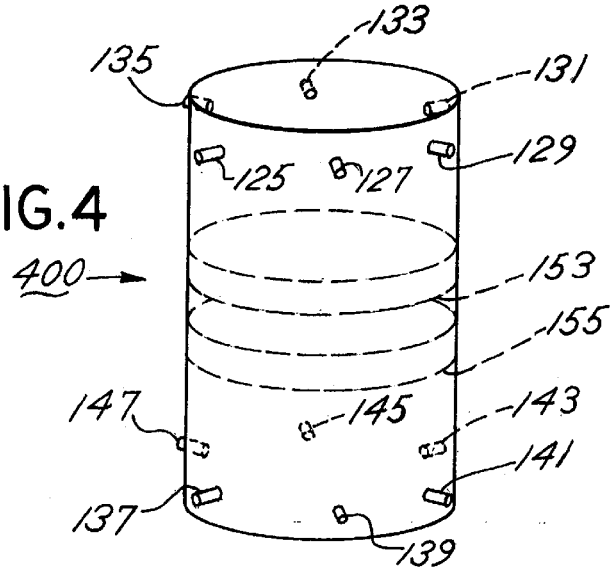

DELAY NETWORK MICROPHONES WITH HARMONIC NESTING

This application claims priority to provisional U.S. Patent Application No. 60/402,185, filed Aug. 9, 2002.

FIELD OF THE INVENTION

The invention relates to multi-element microphones, and more particularly microphones used in conjunction with digital signal processing for telematics applications.

BACKGROUND OF THE INVENTION

Single-element microphones have been used for telematics speech-enabled applications. As an example, these microphones have been used in automotive hands-free cellular applications where good microphone performance is characterized by a combination of high speech recognition scores and high signal-to-vehicle-noise ratio under a variety of vehicle, road, and other noise conditions the driver is likely to encounter. In other words, the more the talker's voice stands out from the background noise produced by the automotive environment itself, the better the performance of the microphone is considered. The target recognition rate for the industry for these telematics applications exceeds 99% under all conditions. Also, teleconferencing and installed sound applications may suffer from similar problems when single element microphones are used in environments that are associated with reverberation and ventilation noise.

In the automotive environment, a typically used microphone is a first order gradient, in which a single-element microphone is employed in a surface mount configuration designed to minimize pickup of vehicle noise and reverberation originating in a direction away from the talker. These microphones often have a bi-directional or cardioid polar response pattern. However, these microphones have a relatively wide maximum response window (corresponding to an acceptance angle), in which reflective surfaces on all sides of the passenger compartment, such as windows and leather upholstery, degrade performance and result in a low talker-to-vehicle-noise ratio when noisy driving conditions are encountered.

Alternatively, a dual-element microphone system in an array configuration may be employed in conjunction with digital signal processing to eliminate the undesired signal from the talker's voice. Such a solution makes use of time-of-arrival information in identifying and amplifying a talker whose voice is received within an acceptance angle of a two-element array in order to reject noise from outside of the acceptance angle. With the array configuration, the talker's voice may be isolated satisfactorily from undesired speech or speech-like noise (such as a passenger's voice) in the horizontal plane. However, the system does not perform well with noise in the vertical plane, such as acoustical signals that emanate from audio speakers located in the vehicle. In addition, these systems require multiple microphone elements, as well as expensive hardware and software systems for performing the digital signal processing. A microphone arrangement coupled to a digital processor is typically expensive for automotive applications. Moreover, these systems have not demonstrated high speech recognition scores.

The approaches of the prior art, as described heretofore, provide acoustical systems having acoustical response characteristics that are not amenable for directive automotive acoustical applications. Thus, it would be an advancement in the art to provide method and apparatus that supports increased directivity and environmental rejection for a variety of applications including hands-free mobile phone use and telematics applications. Furthermore, it is desired that an acoustical system be cost effective, while having the capability of selectively processing distant acoustical sources.

BRIEF SUMMARY OF THE INVENTION

The inventive method and apparatus overcome the problems of prior art by utilizing a plurality of port sub-arrays, in which each port sub-array comprises a plurality of acoustical ports. The ports of each port sub-array are spaced so that each port sub-array responds to acoustical signals generated by acoustical sources within an associated frequency range. In an embodiment of the invention, associated frequency ranges are related in a harmonic manner, in which each port sub-array corresponds to different frequency bands. The associated frequency range is a portion of the total frequency range of an acoustical system. Received acoustical signals from each of the port sub-arrays are coupled over acoustical pathways and are converted into electrical signals by capsules that may be mounted in a capsule mounting. The electrical signals may be filtered, such as to reduce spatial aliasing, and post processed to further enhance the frequency response of the array microphone.

In an embodiment of the invention, an acoustical system is configured to process acoustical signals within a desired horizontal angle and a vertical angle, while suppressing acoustical signals lying outside the angular ranges. The embodiment is configured such that voice recognition performance is enhanced. With a variation of embodiment, which may be applicable to automotive telematics, the port sub-arrays are mounted in a mirror casing so that a rear-view mirror may be tilted according to a talker's line of sight through a rear window of an automobile, while providing desired directional acoustical characteristics for the talker. Variations of the embodiment support mounting the port sub-arrays in other locations of an automobile such as a steering wheel or instrument cluster. Other embodiments of the invention may process acoustical signals in different acoustical media, such as water, in order to support sonar applications. Further embodiments of the invention may process acoustical signals for controlling speech-enabled devices such as appliances.

BRIEF DESCRIPTION OF THE DRAWINGS

FIG. 2 shows a front view of an automotive mirror configuration that supports the acoustical delay network that is shown in FIG. 1;

FIG. 3 shows a top view of an automotive mirror configuration that supports the acoustical delay network that is shown in FIG. 1;

FIG. 4 shows a capsule mounting that supports the acoustical delay network that is shown in FIG. 1;

DETAILED DESCRIPTION OF THE INVENTION

Figure 1:
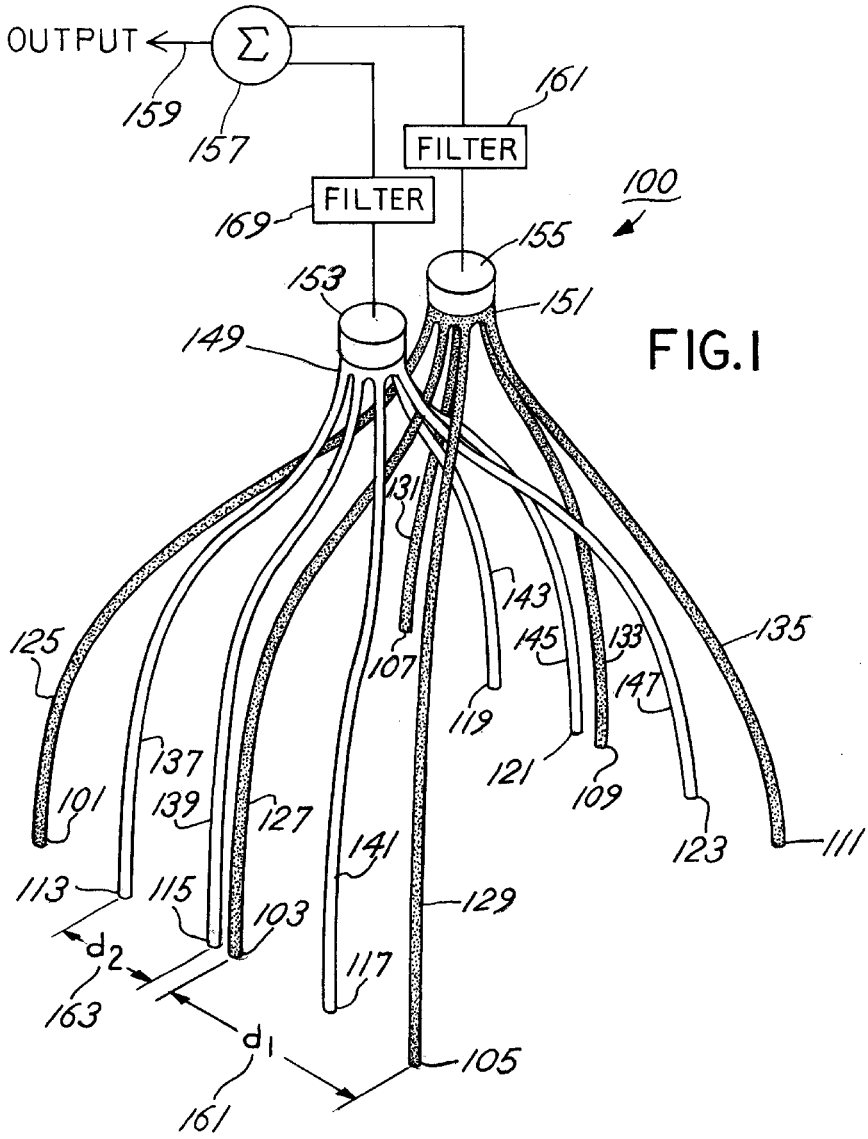
FIG. 1 shows an acoustical delay network with two harmonic sub-arrays according to an embodiment of the invention.

FIG. 1 shows an acoustical system 100 with two port sub-arrays according to an embodiment of the invention. A first port sub-array comprises ports 101, 103, 105, 107, 109, and 111, acoustical pathways 125, 127, 129, 131, 133, and 135, a plenum 151, and a capsule 155. Acoustical pathways 125–135 meet at plenum 151. A second port sub-array comprises ports 113, 115, 117, 119, 121, and 123, acoustical pathways 137, 139, 141, 143, 145, and 147, a plenum 149, and a capsule 153. Acoustical pathways 137–147 meet at plenum 149. In the embodiment, capsules 153 and 155 each comprise a transducer. (Other embodiments of the invention may utilize more than two port sub-arrays, as will be apparent to one skilled in the art.) In the embodiment, pathways 125–135 and 137–147 correspond to tubes having the same length (within a tolerance of error), although other embodiments may utilize other forms of acoustical pathways.

For benefits of describing the embodiments of the invention, the following definitions are used. A "port" refers to an opening that functions as an acoustical ingress for a pipe, tube, capillary, mold passageway, waveguide or other such physical pathway that carries pressure variations from a point outside acoustical delay network 100 to capsule 153 or 155. A "capsule" (e.g. capsule 153 and 155) is a section or subsection of a physical microphone assembly that may include a diaphragm and any additional hardware such as spacers, washers, ports, capillary tubes, resonators that are associated with the transduction of acoustical energy to electrical energy.

Referring to FIG. 1, acoustical signals arriving at each port (101–123) of the port sub-arrays arrives with approximately constant phase with respect to frequency when originating from a particular direction (in this embodiment, perpendicular to the plane or line of the acoustical system 100), whereas acoustical signals arriving at different angles do not possess constant phase relationships. The signals arriving perpendicular to system 100 add coherently (constructively) creating a gain in the acoustical signal strength, referred to as "array gain." Signals arriving from other angles add incoherently (destructively), resulting in attenuation, notches, and nulls in the beampattern as a function of frequency. This principal is typically referred to as "stacking" and the resulting array gain is a function of the number of ports in each harmonic sub-array. Because of these principles, arrays achieve highly directive beams and pick-up patterns. The result is that the array acts as a spatial filter, and acoustical system 100 discriminates between acoustical signals, or sources of acoustical signals, based on direction and signal frequency while a single microphone typically receives acoustical signals from many different directions. The desired sound results in a main beam with a 0° azimuth called the Maximum Response Axis (MRA).

There are several issues associated with port sub-arrays. One issue is spatial aliasing that results in grating lobes, comprising undesirable acoustical signals from undesirable angles, that may have a signal power approximating that of the main (desired) beam and whose behavior is unpredictable and difficult to control. (Grating lobes correspond to beams other than the MRA beam, in which the phase shift between ports of a port sub-array arriving from a given angle cannot be distinguished from N radians or N+k$\pi$ radians, where k is an integer.) In such cases, the undesirable acoustical signals correspond to a half-wavelength that is shorter (i.e. greater in frequency) than the port spacing of the port sub-array.

Another issue is the beam pattern that results from a port sub-array. The main beam of a sub-array is formed from the stacked signal of all the ports in the port sub-array. However, each subset of those ports also creates a beam.

The main beam in acoustical system 100 depends on the desired acoustical signal being received by capsules 153 and 155 at the same time. Thus, identical length tubing (within a tolerance of error) is employed in the embodiment. (However, other embodiments may utilize electronic phase compensation to adjust for different tube lengths.)

Figure 10:
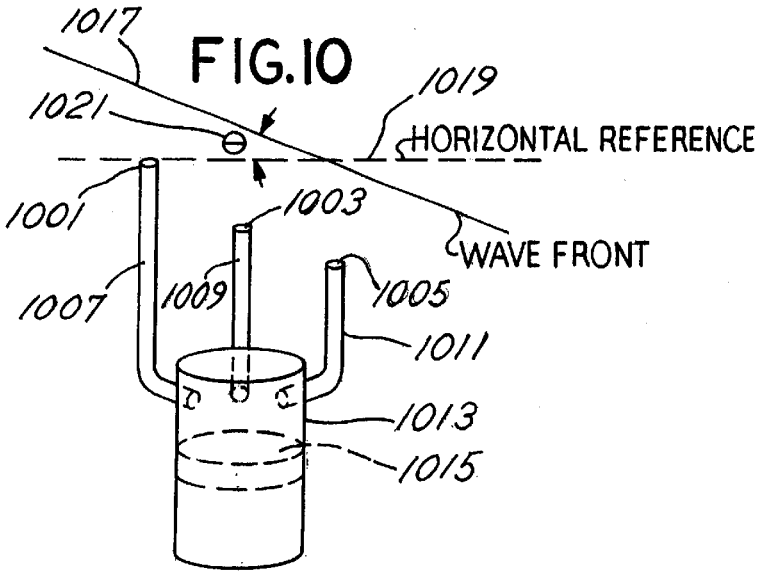
FIG. 10 shows an acoustical pathway configuration that steers the reception of a transmitted acoustical signal in accordance with an embodiment of the invention.

In electronic (non-acoustic) systems, phase shifting may be accomplished by electrical signal processing that creates a delay between ports. The delays allow an array microphone pointed in a particular direction to have a main (desired) beam that is not perpendicular to the array in the azimuth. The MRA, then, is shifted to the angle of the azimuth. Correspondingly, in an acoustic system, a phase shift is achieved by utilizing a second network of tubing with the same or coincident ports and specified staggered lengths to create acoustic propagation delays. (The formation of acoustical phase shifts will be discussed in another aspect of the invention as shown in FIG. 10.)

It is possible to achieve an approximate constant beamwidth with respect to frequency for an acoustical system (e.g. acoustical system 100) by using a plurality of port sub-arrays with increased port spacing such that the spatial aliasing frequency of a port sub-array with larger port spacing is some fraction of the spatial aliasing frequency of another port sub-array with the next-smallest port spacing. Because the beamwidth of a port sub-array becomes smaller for frequencies increasing up to the spatial aliasing frequency, implementing sets of port sub-arrays with gradually decreasing port spacing enables a port sub-array to support a narrow bandwidth for frequencies at which the beamwidth of another sub-array is too wide to be considered desirable. This is typically done at frequencies at double multiples of the of a lower frequency port sub-array (having a larger port spacing), corresponding to port sub-arrays that operate in octaves (e.g. 600–1200 Hz, 1200–2400 Hz, 2400–4800 Hz, and so forth) so that the overall beam pattern of the acoustical system remains essentially constant.

Referring to FIG. 1, adjacent ports (ports 101 and 103, ports 103 and 105, ports 107 and 109, and ports 109 and 111) of the first port sub-array are separated by a first port spacing (d1) 161 and adjacent ports (ports 113 and 115, ports 115 and 117, ports 119 and 121, and ports 121 and 123) of the second port sub-array are separated by a second port spacing (d2) 163. First port spacing 161 is approximately a half wavelength ($\lambda 1$) of a first upper frequency of a corresponding frequency response of the first port sub-array and second port spacing 163 is approximately a half wavelength of a second upper frequency of a corresponding frequency response of the second port sub-array. As will be discussed in greater detail in relation to FIG. 5, the first upper frequency is selected as approximately 2,000 Hz and the second upper frequency is selected as approximately 4,000 Hz, which are separated by one octave from each other. Correspondingly, the first distance is approximately 8.6 cm and the second distance is approximately 4.3 cm.

In FIG. 1, a first electrical signal that is generated by capsule 153 and a second electrical signal that is generated by capsule 155 are provided to an adder 157 through filters 169 and 161, respectively, in order to form an output 159. (Operation of filters 169 and 161 are discussed in the context of FIG. 6.) Output 159 may be further processed, as discussed later, and may be utilized by another processing unit such as a telematics processing unit or wireless communications telephone in order to provide hands-free operation.

In other embodiments of the invention, more than two port sub-arrays may be supported. Each port sub-array may be coupled to a capsule, in which an output of a capsule is coupled to electronic circuitry for bandpass filtering and possibly for further processing.

Figure 9:
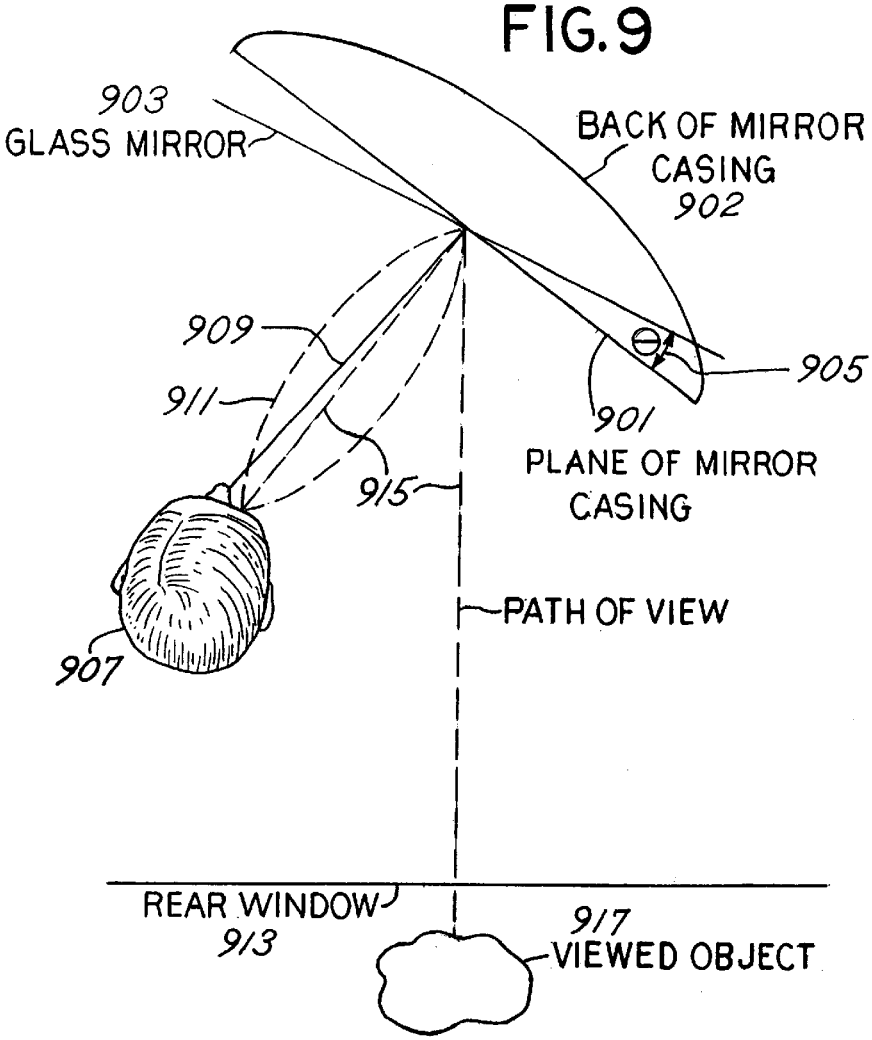
FIG. 9 shows a mirror-tilting configuration in conjunction with the acoustical delay network that is shown in FIG. 1.

FIG. 2 shows a front view of an automotive mirror configuration 201 that supports acoustical delay network 100 that is shown in FIG. 1. A glass mirror (not shown and corresponding to a glass mirror 903 as shown in FIG. 9) spans an approximate area of automotive mirror configuration 201. Ports 101–123 are situated around a periphery of automotive mirror configuration 201 (corresponding to a mirror casing 1001 as shown in FIG. 10). Capsules 153 and 155 are typically positioned in the interior of automotive mirror configuration 201 (not typically visible to a user) and behind the glass mirror. Ports 101, 113, 115, 103, 117, and 105 are separated from ports 107, 119, 121, 109, 123, and 111 by a vertical distance (d3) 207.

Figure 5:
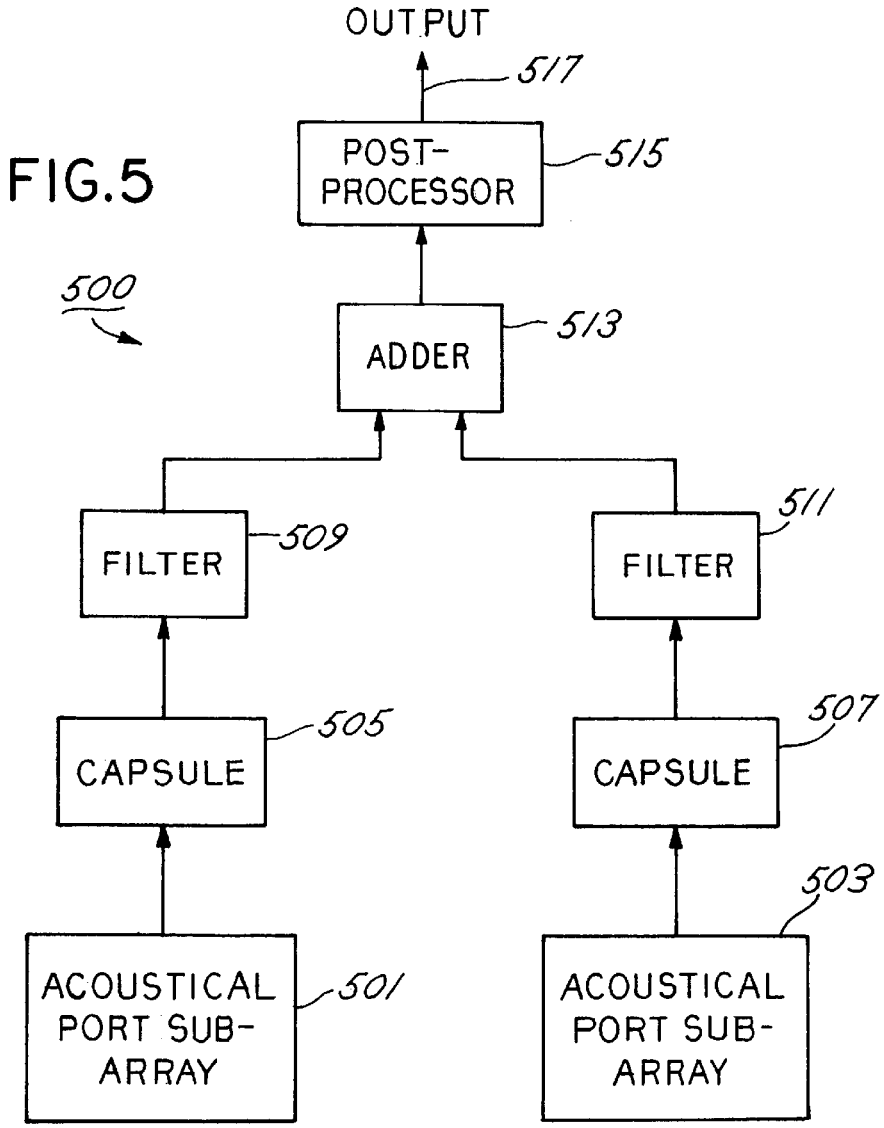
FIG. 5 shows an architectural configuration of the acoustical delay network that is shown in FIG. 1.

FIG. 3 shows a top view of automotive mirror configuration 201 that supports the acoustical delay network 100 that is shown in FIG. 1. Ports 101–123 are positioned in a wall 301 of the mirror casing. Ports 101–123 are connected to capsules 153 and 155 through acoustical pathways 125–147. A connection 315 couples capsule 153 to electronic circuitry (e.g. filter 509, adder 513, and post-processor 515 as shown in FIG. 5) and a connection 317 couples capsule 155 to electronic circuitry (e.g. filter 511, adder 513, and post-processor 515 as shown in FIG. 5). Although FIG. 3 shows the electronic circuitry external to the mirror casing, the electronic circuitry may reside within mirror configuration 201 in other embodiments of the invention.

The embodiment shown in FIGS. 2, 3, and 9 utilizes a rear-view mirror for housing acoustical system 100. However, other embodiments of the invention may utilize other locations in an automobile, including a steering wheel and an instrument panel.

While the embodiment that is shown in FIGS. 1–3 support a planar array, other embodiments of the invention may support a three-dimensional array, in which the first acoustical sub-array comprises additional ports that are separated from ports 101–111 by a depth distance (perpendicular to the vertical distance and the horizontal distance) and the second acoustical sub-array comprises additional ports that are separated from ports 113–123 by the depth distance.

FIG. 4 shows a capsule mounting 400 that supports acoustical delay network 100 that is shown in FIG. 1. Capsule mounting 400 houses capsules 153 and 155 and acoustically couples acoustical pathways 125–147. In the embodiment, acoustical pathways 125–135 are coupled to one side of capsule 153 and acoustical pathways 137–147 are coupled to a same side of capsule 155. With other embodiments, acoustical pathways 125–147 may be located differently with respect to capsules 153 and 155. In one embodiment, acoustical pathways 125–137 may be coupled on different sides for capsule 153, and acoustical pathways 137–147 are coupled on different sides of capsule 155, where an acoustical barrier between a proximity of capsule 153 and a proximity of capsule 155 provides acoustical isolation between capsules 153 and 155. In other embodiments of the invention, capsule mounting 400 may vary to accommodate a different configuration such as a different type of capsule.

For a received voice signal in an automotive environment, experimental results suggest that a relative degree of voice recognition is good if the received voice signal is processed with exemplary filter configurations having limiting frequency characteristics such as with a 1000 Hz to 4000 Hz bandpass filter, a 1000 Hz to 5000 Hz bandpass filter, an octave filter centered at 2000 Hz, or a high pass filter with a corner frequency of 1000 Hz. An experimental configuration utilized an IBM Via Voice™ Recognition Engine, in which different microphone types were positioned at different points within an automobile.

FIG. 5 shows an architectural configuration 500 of acoustical delay network 100 that is shown in FIG. 1. Architectural configuration 500 comprises acoustical port sub-arrays 501 and 503, capsules 505 and 507, filters 509 and 511 (corresponding to filters 169 and 161, respectively, as shown in FIG. 1), an adder 513, and a post-processor 515 that provides an output 517. Output 517 may be used for a number of applications, including hands-free wireless terminals and telematics. Acoustical port sub-array 501 corresponds to ports 101–111 (as shown in FIG. 1) and acoustical port sub-array 503 corresponds to ports 113–123. Capsules 505 and 507 correspond to capsules 155 and 153 (as shown in FIG. 1). In the embodiment, filter 509 is a bandpass filter having an approximate pass-band of 1 KHz to 2 KHz and filter 511 is a bandpass filter having an approximate pass-band of 2 KHz to 4 KHz. Filters 509 and 511 reduce spatial grating that may be associated with acoustical port sub-array 501 and 503, respectively.

Adder 513 combines the signals from filter 509 and filter 511 so that the corresponding combined frequency response of architectural configuration 500 is approximately 1 KHz to 4 KHz. (Experimental results, as discussed above, suggests a good relative measure of speech recognition in which a received voice signal is processed with a bandpass filter having a pass-band of 1 KHz to 4 KHz.) A post-processor 515 may modify a signal from adder 513 in order to dampen irregularities in the signal response characteristics that result from a quarter wavelength ($\lambda/4$) response of acoustical port sub-array 501 and acoustical port sub-array 503. (In some embodiments, post-processing unit 515 may also be capable of supporting a post-equalization filter to provide for a flat response with respect to frequency over an operational region of acoustical system 100. This type of optimized filter is often referred to as a frequency domain "inverse" filter or an optimally converged adaptive/"Wiener" filter.) In other embodiments of the invention, quarter wavelength damping may utilize partial acoustical blockage (e.g. a foam material) in acoustical pathways 125–147. In other embodiments of the invention, quarter wavelength damping may be provided by filters 509 and 511 such that filter 509 dampens (attenuates) the quarter wavelength response of acoustical port sub-array 501 (corresponding to approximately 1000 Hz for the embodiment as shown in FIG. 2), and filter 511 dampens the quarter wavelength response of acoustical port sub-array 503 (corresponding to approximately 2000 Hz for the embodiment as shown in FIG. 2). Additional damping of quarter-wavelength resonances in the tubing network may be implemented using acoustical filters consisting of tubes, pipes, plenums, and resistances that augment or supplant notching as implemented using foam impedances or electronic means.

In the embodiment, a higher order pickup pattern is defined as a pattern resulting from the combination of low order or "common" pickup patterns that may be adjusted by delay or amplitude weighting (such as a foam impedance in the ports or tubes). Examples of low order patterns include omnidirectional microphones (zero-th order), cardioids (first order), super-cardioids (first order with different path difference delay than cardioids), and hyper-cardioids. Higher order beam patterns result from combining these inputs in various combinations, such as a second order finite difference (two cardioids separated by a half wavelength with the second delayed by the travel-time between the two).

In some embodiments, it may be advantageous to include some type of analog or digital sub-array processing between capsule 505 or 507 and adder 513. In the case where digital signal processing is applied, bandpass filters 509 and 511 and sub-array processing may be accomplished on the same processor (e.g. a microprocessor). In some embodiments, bandpass filters 509 and 511, subarray processing, adder 513, and post processor 515 may be implemented on the same processor (in which the entire system is behind capsules 153 and 155.

Even though the embodiment that is shown in FIGS. 1–5 is directed toward automotive applications, other embodiments of the invention may be directed to other acoustical applications such as high fidelity acoustical applications, audio conferencing, speakerphones, podium microphones, in-car intercoms, multimedia computers, drive-through communications systems, security or surveillance systems, speech-controlled appliances, and sonar applications. While some acoustical applications of the present invention may be associated with an air medium, applications (e.g. sonar applications), as may be apparent to those skilled in the art, may be associated with a water medium.

The embodiment that is shown in FIGS. 1–3 support a frequency spectrum from approximately 1 KHz to 4 KHz with two harmonic nests (port sub-arrays) in order to provide a good relative measure of speech recognition accuracy. However, other acoustical applications may require one skilled in the art to consider other design parameters. For example, in some embodiments that support high fidelity acoustical applications, a frequency spectrum from approximately 100 Hz to 16 KHz may be desired. In such a case, seven port sub-arrays may be incorporated, in which a first port sub-array corresponds to a frequency band of 125 Hz to 250 Hz, a second port sub-array corresponds to a frequency band of 250 Hz to 500 Hz, a third port sub-array corresponds to a frequency band of 500 Hz to 1 KHz, a fourth port sub-array corresponds to a frequency band of 1 KHz to 2 KHz, a fifth port sub-array corresponds to a frequency band of 2 KHz to 4 KHz, a sixth port sub-array corresponds to a frequency band of 4 KHz to 8 KHz, and a seventh port sub-array corresponds to a frequency band of 8 KHz to 16 KHz. Also, embodiments of the invention may consider different error criteria such as a measure of speech recognition accuracy and mean square error (MSE). Mean square error may be useful in gauging the processing fidelity of non-speech acoustical signals such as musical sounds.

Figure 6:
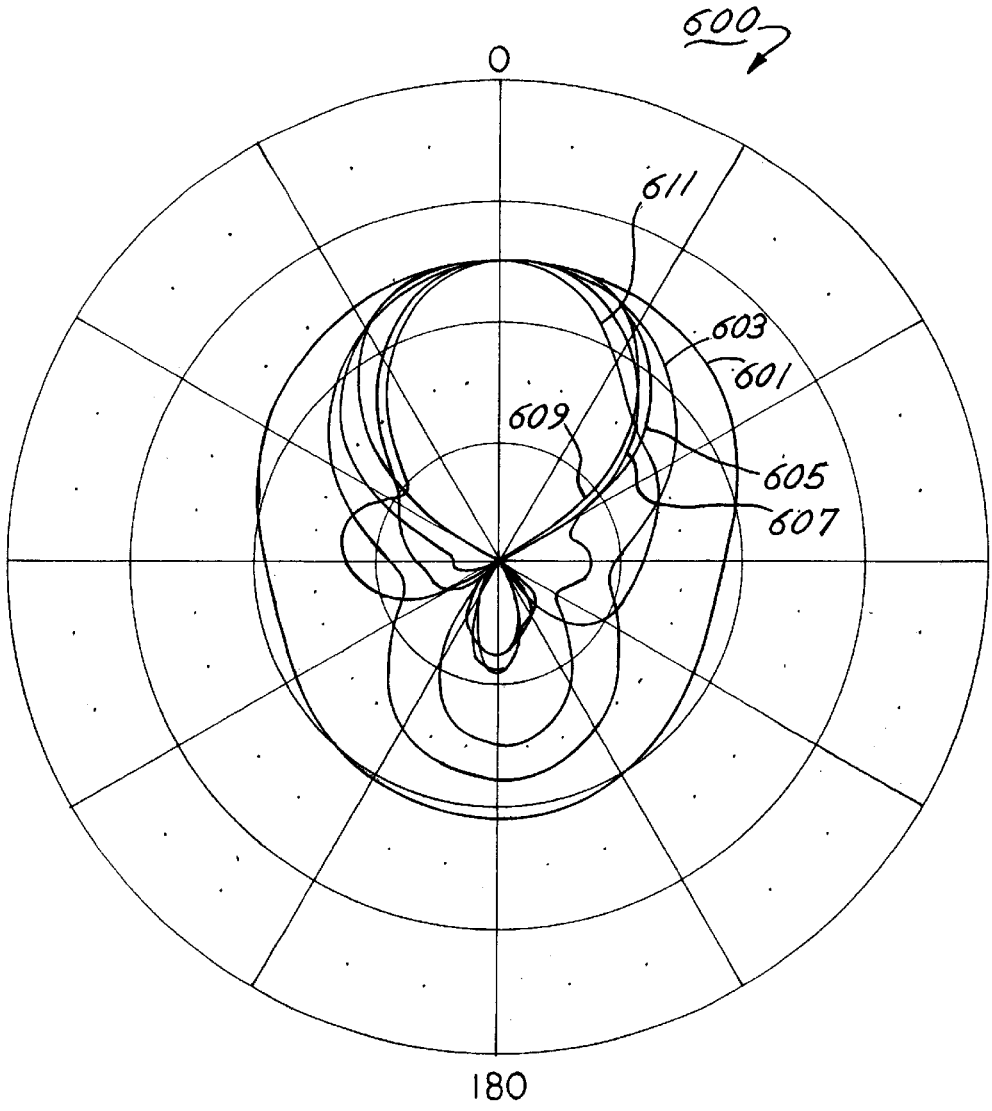
FIG. 6 shows a polar plot of the horizontal directivity of the acoustical delay network that is shown in FIG. 1.

FIG. 6 shows a polar plot 600 of the horizontal directivity of acoustical delay network 100 that is shown in FIG. 1. Polar plot 600 shows frequency responses for 800 Hz, 1000 Hz, 1500 Hz, 2000 Hz, 2500 Hz, and 3000 Hz corresponding to curves 601, 603, 605, 607, 609, and 611, respectively. Each curve shows the horizontal directional response for the associated frequency with respect to the zero-degree azimuth of acoustical delay network 100. Typically, within each harmonic sub-array, the higher the frequency, the greater the directivity (i.e. the narrower the beamwidth) of acoustical delay network 100. The use of multiple nests maintains approximately constant directivity over the operational range of the device.

Figure 7:
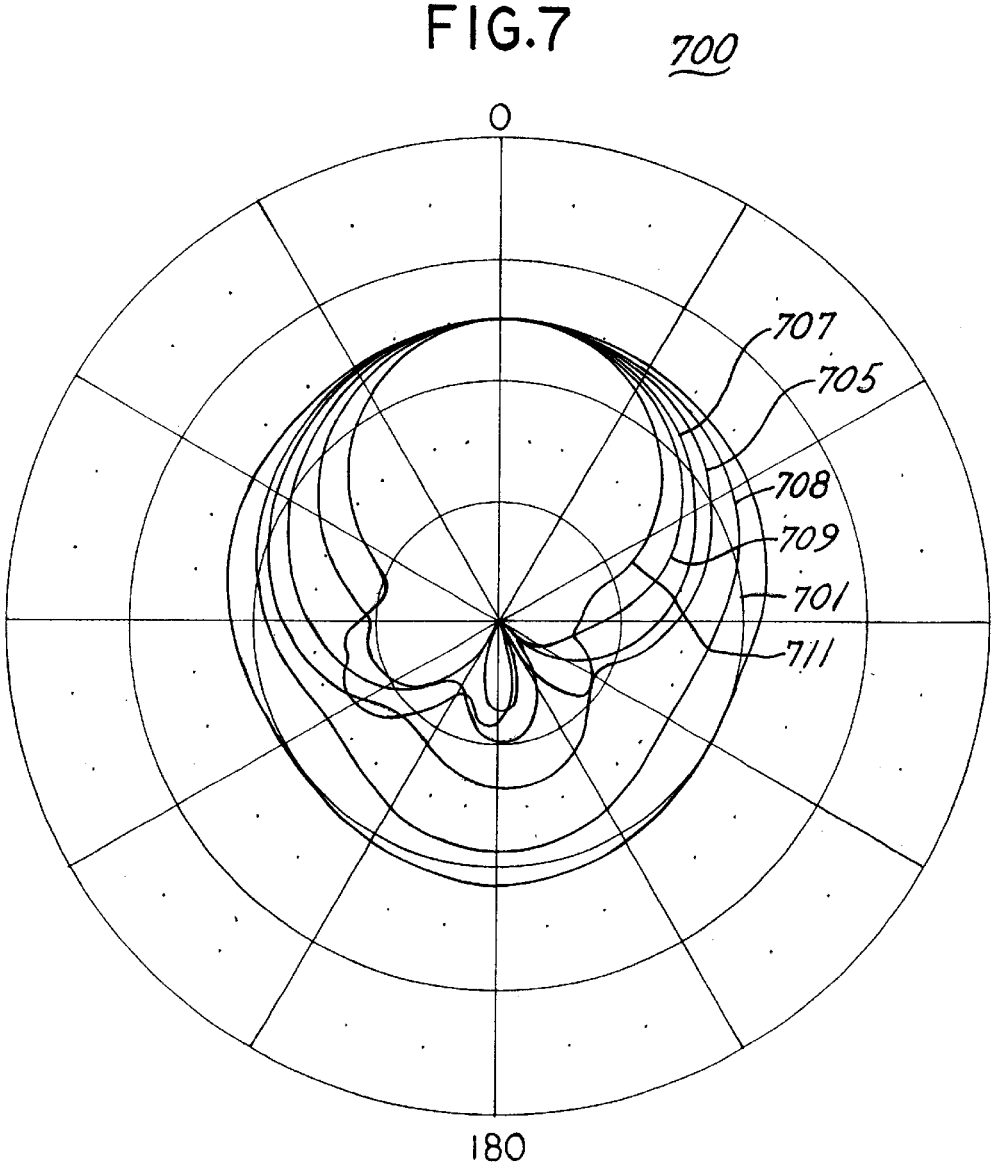
FIG. 7 shows a polar plot of the vertical directivity of the acoustical delay network that is shown in FIG. 1.

FIG. 7 shows a polar plot 700 of the vertical directivity of acoustical delay network 100 that is shown in FIG. 1. Polar plot 700 shows frequency responses for 800 Hz, 1000 Hz, 1500 Hz, 2000 Hz, 2500 Hz, and 3000 Hz corresponding to curves 701, 703, 705, 707, 709, and 711, respectively. Typically, the vertical directivity increases as the frequency increases. The embodiment possesses only one "nest" in the vertical direction, but other embodiments may utilize a plurality of nests in the vertical (Y) dimension or depth (Z) dimension as is applied in the horizontal (X) dimension.

Figure 8:
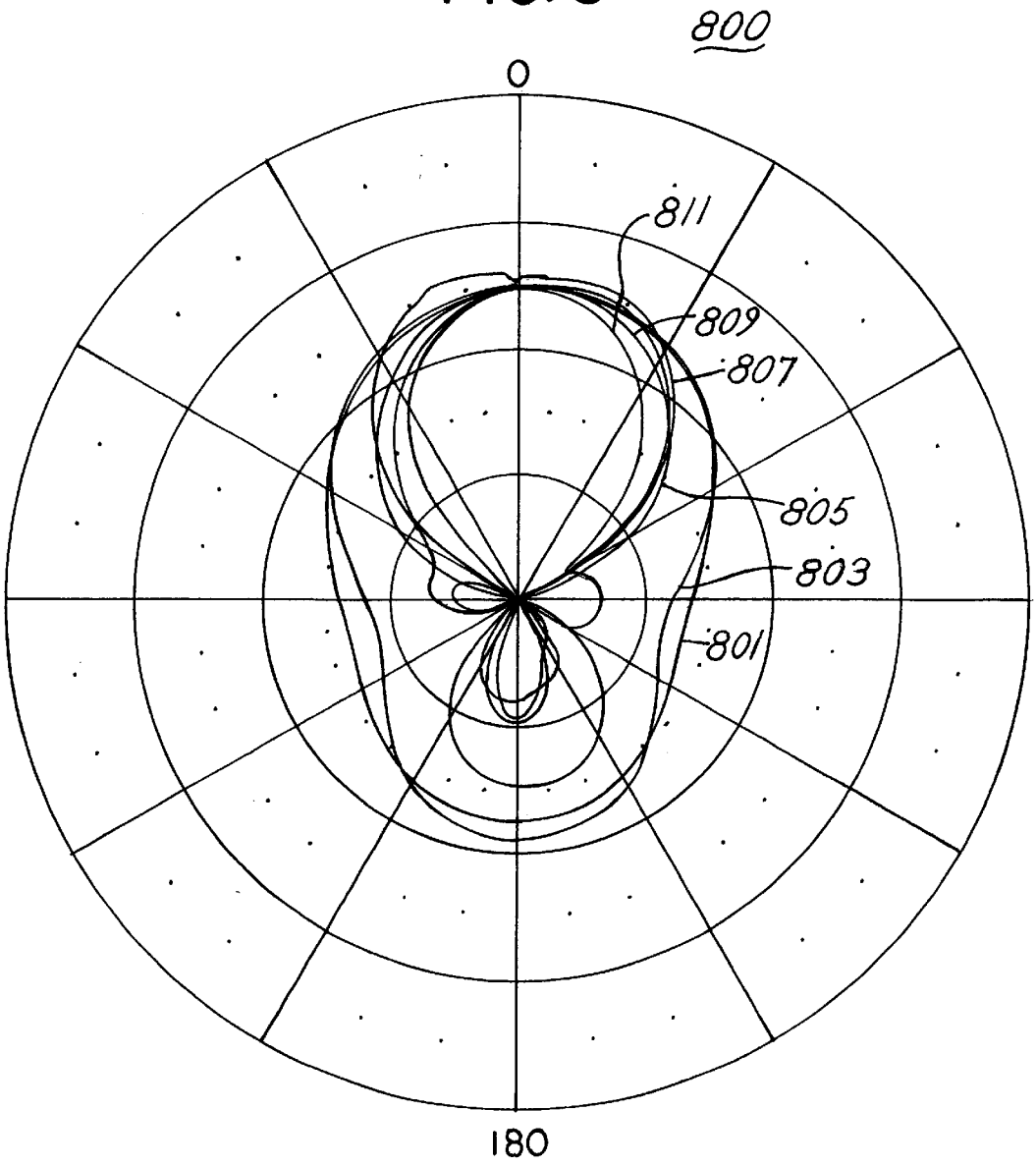
FIG. 8 shows a polar plot of the horizontal directivity of the acoustical delay network that is shown in FIG. 1 with quarter wavelength damping applied.

FIG. 8 shows a polar plot 800 of the horizontal directivity of acoustical delay network 100 that is shown in FIG. 1 with quarter wavelength damping applied. Polar plot 800 shows frequency responses for 800 Hz, 1000 Hz, 1500 Hz, 2000 Hz, 2500 Hz, and 3000 Hz, corresponding to curves 801, 803, 805, 807, 809, and 811 respectively. As with polar plot 600, typically the horizontal directivity increases as the frequency increases. However, comparing plot 611 (as shown in FIG. 6) with plot 811 (corresponding to 3000 Hz), the side lobes are reduced with quarter wavelength damping.

FIG. 9 shows a mirror-tilting configuration in conjunction with acoustical delay network 100 that is shown in FIG. 1. Acoustical delay network 100 is mounted in mirror casting 901 (corresponding to 201 in FIGS. 2 and 3). Mirror casting 901 is tilted at an angle θ 905 with respect to glass mirror 903. A talker 907 talks within a main beamwidth 911 of acoustical delay network 100, over an acoustical path 909 (corresponding to a perpendicular to a plane of acoustical delay network 100). Because glass mirror 903 is tilted with respect to mirror casing 901, talker can also view an object 917 through a rear window 913 corresponding to a view path 915. View path 915 forms an angle such that a perpendicular to glass mirror 903 bisects the angle.

FIG. 10 shows an acoustical pathway configuration that steers the reception of a transmitted acoustical signal in accordance with an embodiment of the invention. Ports 1001, 1003, and 1005 receive an acoustical signal corresponding to a wave front 1017 that is incident to acoustical delay network 100 at an angle θ 1021 with respect to a horizontal reference 1019. Ports 1001, 1003, and 1005 are openings in acoustical pathways 1007, 1009, and 1011, respectively. Acoustical pathways 1007, 1009, and 1011 differ in length in order that the Maximum Response Axis (main beam) is tilted by angle θ 1021. The tilting of the main beam corresponds to a differential length between adjacent acoustical pathways (e.g. 1007 and 1009) that is approximately equal to $d*SIN(\theta)$, where d is the port spacing between adjacent ports. Tilting the main beam facilitates the mounting of acoustical delay network 100 for mounting entities that are not easily adjusted such as a steering wheel or an instrument panel.

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. An acoustical system for processing at least one transmitted acoustical signal that propagates through an acoustical medium, wherein one of the at least one transmitted acoustical signals is a desired transmitted acoustical signal, the acoustical system comprising:

an acoustical port array comprising a plurality of port sub-arrays, wherein the desired transmitted acoustical signal is generated by an acoustical source that is located at a horizontal angle with respect to the acoustical port array;

a first port sub-array that is associated with the acoustical port array, the first port sub-array comprising a first port and a second port that are spatially separated by a first horizontal distance from each other, the first port receiving a first received signal and the second port receiving a second received signal;

a second port sub-array that is associated with the acoustical port array, the second port sub-array comprising a third port and a fourth port that are spatially separated by a second horizontal distance from each other, the third port receiving a third received signal and the fourth port receiving a fourth received signal;

a first capsule comprising a first transducer;

a second capsule comprising a second transducer;

a first acoustical pathway configuration comprising a first acoustical pathway that couples the first received signal to the first transducer and a second acoustical pathway that couples the second received signal to the first transducer, wherein the first transducer generates a first electrical signal comprising a first signal component corresponding to the desired transmitted acoustical signal over a first frequency range; and a second acoustical pathway configuration comprising a third acoustical pathway that couples the third received signal to the second transducer and a fourth acoustical pathway that couples the fourth received signal to the second transducer, wherein the second transducer generates a second electrical signal comprising a second signal component corresponding to the desired transmitted acoustical signal over a second frequency range.

2. The acoustical system of claim 1, wherein a first port spacing between the first and second port is approximately equal to a half wavelength that corresponds to a first upper frequency limit of the first port sub-array, and wherein a second port spacing between the third and fourth port is approximately equal to a half wavelength that corresponds to a second upper frequency limit of the second port sub-array.

3. The acoustical system of claim 1, further comprising:

a first bandpass filter that essentially passes electrical components over the first frequency range in order to obtain a first modified electrical signal from the first electrical signal; and a second bandpass filter that essentially passes electrical components over the second frequency range in order to obtain a second modified electrical signal from the second electrical signal.

4. The acoustical system of claim 3, further comprising:

an adder that combines the first modified electrical signal and the second modified electrical signal in order to provide an output signal, wherein the output signal enhances the desired transmitted acoustical signal over an output frequency range that is essentially equal to the first frequency range plus the second frequency range.

5. The acoustical system of claim 4, further comprising:

a post-processing unit that affects a first frequency component at approximately a quarter wavelength that corresponds to a first upper frequency limit of the first port sub-array and a second frequency component at approximately a quarter wavelength that corresponds to a second upper frequency limit of the second port sub-array.

6. The acoustical system of claim 5, wherein the post-processing unit reduces a first frequency component that is equal to approximately a quarter wavelength that corresponds to a first upper frequency limit of the first port sub-array and reduces a second frequency component that is equal to approximately a quarter wavelength that corresponds to a second upper frequency limit of the second port sub-array.

7. The acoustical system of claim 6, wherein the post-processing unit comprises a post-equalization filter that provides a flat response with respect to frequency over an operational region of the acoustical system.

8. The acoustical system of claim 3, wherein the first bandpass filter reduces a first frequency component that is equal to approximately a quarter wavelength that corresponds to a first upper frequency limit of the first port sub-array, and wherein the second bandpass filter reduces a second frequency component that is equal to approximately a quarter wavelength that corresponds to a second upper frequency limit of the second port sub-array.

9. The acoustical system of claim 1, wherein the desired transmitted acoustical signal is generated by the acoustical source that is located at a vertical angle with respect to the acoustical port array, wherein the first port sub-array further comprises a fifth port that is spatially separated from the first port by a vertical distance, the fifth port receiving a fifth received signal, wherein the second port sub-array further comprises a sixth port that is spatially separated from the third port by the vertical distance, the sixth port receiving a sixth received signal, wherein the first acoustical pathway configuration further comprises a fifth acoustical pathway that couples the fifth received acoustical signal to the first transducer, and wherein the second acoustical pathway configuration further comprises a sixth acoustical pathway that couples the sixth received acoustical signal to the second transducer.

10. The acoustical system of claim 9, wherein the first port sub-array further comprises a seventh port that is spatially separated from the first port by a third distance, the third distance being perpendicular to the vertical distance and the horizontal distance, the seventh port receiving a seventh received signal, wherein the second port sub-array further comprises a eighth port that is spatially separated from the third port by the third distance, the eighth port receiving a eighth received signal, wherein the first acoustical pathway configuration further comprises a seventh acoustical pathway that couples the seventh received acoustical signal to the first transducer, the eight port receiving an eighth received signal, and wherein the second acoustical pathway configuration further comprises a eighth acoustical pathway that couples the eighth received acoustical signal to the second transducer.

11. The acoustical system of claim 1, further comprising:

a capsule mounting that houses the first capsule and the second capsule and that couples the first and second acoustical pathway configurations to the first and second capsules.

12. The acoustical system of claim 11, wherein the capsule mounting comprises a first set of entry points for a first plurality of acoustical pathways and a second set of entry points for a second plurality of acoustical pathways, wherein the first set of entry points is located on one side of the first capsule, and wherein the second set of entry points is located on the same side of the second capsule.

13. The acoustical system of claim 11, wherein the capsule mounting comprises a first set of entry points for a first plurality of acoustical pathways and a second set of entry points for a second plurality of acoustical pathways, wherein the first set of entry points is located on both sides of the first capsule, and wherein the second set of entry points is located on both sides of the second capsule, the acoustical system further comprising:

an acoustical barrier that acoustically separates a first proximity of the first capsule and a second proximity of the second capsule.

14. The acoustical system of claim 1, wherein the acoustical medium is selected from the group consisting of an air medium and a water medium.

15. The acoustical system of claim 1, wherein each of the acoustical pathways is selected from the group consisting of a tube, a pipe, a capillary, a waveguide, and a molded passage within an acoustical housing.

16. The acoustical system of claim 1, wherein the second frequency range is approximately one octave separated from the first frequency range.

17. The acoustical system of claim 1, wherein the first frequency range and the second frequency range are configured in order to enhance a measure of speech recognition accuracy.

18. The acoustical system of claim 17, wherein the first and second electrical signals are inputted to a speech recognition unit.

19. The acoustical system of claim 17, wherein the first and second electrical signals are inputted to a communications device.

20. The acoustical system if claim 19, wherein the communications device is selected from the group consisting of a telephone instrument, a computer, and a speech-enabled device.

21. The acoustical system of claim 1, wherein the first frequency range and the second frequency range are configured in order to reduce a mean square error of an output signal in relation to the desired transmitted acoustical signal.

22. The acoustical system of claim 1, further comprising:

a first insert that resides within the first acoustical pathway in order to reduce a first frequency component that is equal to approximately a quarter wavelength that corresponds to a first upper frequency limit of the first port sub-array; and a second insert that resides within the third acoustical pathway in order to reduce a second frequency component that is equal to approximately a quarter wavelength that corresponds to a second upper frequency limit of the second port sub-array.

23. The acoustical system of claim 1, wherein the first port sub-array and the second port sub-array reside in a mirror casing, wherein the mirror casing is tilted so that a perpendicular to a plane of the mirror casing approximately intersects at a mouth of a talker, wherein a mirror's plane is tilted at a different angle from that of the mirror casing, and wherein a perpendicular to the mirror's plane approximately bisects a viewing angle between the talker and a rear window.

24. The acoustical system of claim 1, wherein the first port sub-array and the second port sub-array reside in a mirror casing, and wherein the acoustical pathways differ in length so that a main beam is tilted.

25. The acoustical system of claim 1, further comprising:

a third port sub-array that is associated with the acoustical port array, the third port sub-array comprising a fifth port and a sixth port that are spatially separated by a third horizontal distance from each other, the fifth port receiving a fifth received signal and the sixth port receiving a sixth received signal;

a third capsule comprising a third transducer;

a third acoustical pathway configuration comprising a fifth acoustical pathway that couples the fifth received signal to the third transducer and a sixth acoustical pathway that couples the sixth received signal to the third transducer, wherein the third transducer generates a third electrical signal comprising a third signal component corresponding to the desired transmitted acoustical signal over a third frequency range.

26. The acoustical system of claim 1, further comprising:

a first acoustical filter associated with the first acoustical pathway, the first acoustical pathway comprising at least one branch.

27. The acoustical system of claim 26, wherein a first branch of the at least one branch terminates in an acoustical impedance, and wherein the acoustical impedance is selected from the group consisting of at least one opening to air, at least one pipe connected to a plenum, and a combination of the at least one opening to air and the at least one pipe connected to the plenum.

28. The acoustical system of claim 26, wherein a plurality of branches are coupled to a directional microphone capsule and are affected by different impedances on each branch, wherein the plurality of branches affect ducted acoustic waves so that characteristics of a combined port and microphone pair is associated with a higher order pickup pattern.

29. The acoustical system of claim 28, wherein the higher order pickup pattern is selected from the group consisting of a zeroth order pickup pattern, a first order pickup pattern, and a second order pickup pattern, wherein the zeroth order pickup pattern corresponds to an omnidirectional pattern, the first order pickup pattern corresponds to a cardioid, supercardioid, or hypercardioid pattern, and the second order pickup pattern corresponds to a finite difference of first order inputs.

30. The acoustical system of claim 1, wherein a plurality of branches are coupled to a directional microphone capsule and wherein the plurality of branches affect ducted acoustic waves so that characteristics of a combined port and microphone pair is associated with a higher order pickup pattern.

31. The acoustical system of claim 30, wherein each of the plurality of branches is affected by an associated impedance.

32. The acoustical system of claim 1, wherein a first difference between a first length of the first acoustical pathway and a second length of the second acoustical pathway, and a second difference between a third length of the third acoustical pathway and a fourth length of the fourth acoustical pathway affects a main beam of the acoustical port array to vary angularly from a zero-degree azimuth.

33. A method for processing at least one transmitted acoustical signal that propagates through an acoustical medium, wherein one of the at least one transmitted acoustical signal is a desired transmitted acoustical signal, the method comprising:

(a) receiving a first received signal by a first port of a first port sub-array;

(b) receiving a second received signal by a second port of the first port sub-array, wherein the first port and the second port are spatially separated by a first horizontal distance from each other;

(c) receiving a third received signal by a third port of a second port sub-array;

(d) receiving a fourth received signal by a fourth port of the second port sub-array, wherein the third port and the fourth port are spatially separated by a second horizontal distance from each other;

(e) coupling, to the first transducer, the first received signal through a first acoustical pathway and the second received signal through a second acoustical pathway;

(f) coupling, to the second transducer, the third received signal through a third acoustical pathway and the fourth received signal through a fourth acoustical pathway;

(g) generating, by the first transducer, a first electrical signal from the first received signal and the second received signal, wherein the first electrical signal comprises a first signal component corresponding to the desired transmitted acoustical signal over a first frequency range; and (h) generating, by the second transducer, a second electrical signal from the third received signal and the fourth received signal, wherein the second electrical signal comprises a second signal component corresponding to the desired transmitted acoustical signal over a second frequency range.

34. The method of claim 33, the method further comprising:

(i) passing electrical components through a bandpass filter over the first frequency range in order to obtain a first modified electrical signal from the first electrical signal; and (j) passing electrical components through a second bandpass filter over the second frequency range in order to obtain a second modified electrical signal from the second electrical signal.

35. The method of claim 34, the method further comprising:

(k) combining the first modified electrical signal and the second modified electrical signal in order to provide an output signal, wherein the output signal enhances the desired transmitted acoustical signal over an output frequency range that is essentially equal to the first frequency range plus the second frequency range.

36. The method of claim 35, the method further comprising:

(l) reducing a first frequency component at approximately a quarter wavelength that corresponds to a first upper frequency limit of the first port sub-array; and (m) reducing a second frequency component at approximately a quarter wavelength that corresponds to a second upper frequency limit of the second port sub-array.

37. A computer-readable medium having computer-executable instructions for performing the method of claim 33.

38. A computer-readable medium having computer-executable instructions for performing the method of claim 34.

39. A computer-readable medium having computer-executable instructions for performing the method of claim 35.

40. A computer-readable medium having computer-executable instructions for performing the method of claim 36.

41. An acoustical system for processing at least one transmitted acoustical signal that propagates through an acoustical medium, wherein one of the at least one transmitted acoustical signals is a desired transmitted acoustical signal, the acoustical system comprising:

an acoustical port array comprising a plurality of port sub-arrays, wherein the desired transmitted acoustical signal is generated by an acoustical source that is located at a horizontal angle and at a vertical angle with respect to the acoustical port array;

a first port sub-array that is associated with the acoustical port array, the first port sub-array comprising a first port and a second port that are spatially separated by a first horizontal distance from each other and comprising a fifth port that is spatially separated from the first port by a vertical distance, the first port receiving a first received signal and the second port receiving a second received signal, wherein a first port spacing between the first and second port is approximately equal to a half wavelength that corresponds to a first upper frequency limit of the first port sub-array, the fifth port receiving a fifth received signal;

a second port sub-array that is associated with the acoustical port array, the second port sub-array comprising a third port and a fourth port that are spatially separated by a second horizontal distance from each other and comprising a sixth port that is spatially separated from the third port by the vertical distance, the third port receiving a third received signal and the fourth port receiving a fourth received signal, wherein a second port spacing between the third and fourth port is approximately equal to a half wavelength that corresponds to a second upper frequency limit of the second port sub-array, the sixth port receiving a sixth received signal;

a first capsule comprising a first transducer;

a second capsule comprising a second transducer;

a first acoustical pathway configuration comprising a first acoustical pathway that couples the first received signal to the first transducer, a second acoustical pathway that couples the second received signal to the first transducer, and a fifth acoustical pathway that couples the fifth received acoustical signal to the first transducer, wherein the first transducer generates a first electrical signal comprises a first signal component corresponding to the desired transmitted acoustical signal over a first frequency range;

a second acoustical pathway configuration comprising a third acoustical pathway that couples the third received signal to the second transducer, a fourth acoustical pathway that couples the fourth received signal to the second transducer, and a sixth acoustical pathway that couples the sixth received acoustical signal to the second transducer, wherein the second transducer generates a second electrical signal comprises a second signal component corresponding to the desired transmitted acoustical signal over a second frequency range;

a first bandpass filter that essentially passes electrical components over the first frequency range in order to obtain a first modified electrical signal from the first electrical signal;

a second bandpass filter that essentially passes electrical components over the second frequency range in order to obtain a second modified electrical signal from the second electrical signal;

an adder that combines the first modified electrical signal and the second modified electrical signal in order to provide an output signal, wherein the output signal enhances the desired transmitted acoustical signal over an output frequency range that is essentially equal to the first frequency range plus the second frequency range; and a post-processing unit that provides a desireable frequency response for at least a portion of a complete operational frequency range of the acoustical system and that reduces a first frequency component at approximately a quarter wavelength corresponding to a first upper frequency limit of the first port sub-array and a second frequency component at approximately a quarter wavelength corresponding to a second upper frequency limit of the second port sub-array.

* * * * *